US005664744A

United States Patent [19]

Chew et al.

[11] Patent Number: 5,664,744

[45] Date of Patent: Sep. 9, 1997

[54] RAILWAY HIGHWAY CROSSING SIGNAL

[75] Inventors: James P. Chew, Westmoreland County; Santo A. DeFrancesco, Allegheny County, both of Pa.; Richard S. Jones, Lexington County, S.C.

[73] Assignee: Union Switch & Signal Inc., Pittsburgh, Pa.

[21] Appl. No.: 500,570

[22] Filed: Jul. 11, 1995

[51] Int. Cl.[6] ..... B61L 23/00

[52] U.S. Cl. ..... 246/473.3; 362/382

[58] Field of Search ..... 246/473.3; 362/382, 362/396, 418, 419, 429, 430

[56] References Cited

U.S. PATENT DOCUMENTS

| | | | |
|---|---|---|---|
| 1,822,105 | 9/1931 | Merkel | 246/473.3 |
| 1,918,480 | 7/1933 | Moore | 246/473.3 |
| 2,097,798 | 11/1937 | Moore | 246/473.3 |
| 2,333,967 | 11/1943 | Wells | 246/473.3 |
| 4,700,278 | 10/1987 | Chew | 246/473.3 |

*Primary Examiner*—S. Joseph Morano
*Attorney, Agent, or Firm*—Buchanan Ingersoll, P.C.

[57] ABSTRACT

A railway signal having a housing, in which the housing has an annular ledge thereon. The annular ledge has first and second opposed surfaces. One or more portions of the second ledge surface, preferably cast raised bosses, are machined so as to have a selected height. A reflector is mounted upon the first ledge surface. Also attached to the signal housing is a lamp receptacle bracket. The lamp receptacle bracket has a first end that is mounted upon the one or more machined portions of the second ledge surface. The lamp receptacle bracket also has a second end that has a lamp receptacle attached thereto. An insulating plate is disposed between the lamp receptacle flat portion and the lamp receptacle bracket flat surface.

21 Claims, 4 Drawing Sheets

RAILWAY HIGHWAY CROSSING SIGNAL

BACKGROUND OF THE INVENTION

1. Field of the Invention

This invention relates generally to signals used in railway systems and more particularly to methods and apparatus for mounting the reflector and lamp receptacle of a signal to the signal housing.

2. Description of the Prior Art

Currently in the railroad industry, signals including those used at railroad-highway grade crossings are generally comprised of a reflector enclosed within a cast metallic housing. A lamp receptacle is also mounted within the housing that holds an incandescent electric lamp. The mounting for the incandescent lamp should allow the lamp to be positioned so that light from the lamp will be concentrated by the reflector and directed through an appropriately colored roundel. Thus, the intended observer of a signal will perceive the intended indication of the signal.

A typical prior art signal unit is shown in FIGS. 1 and 2. The reflector used in the signal units of the prior art is mounted to the as-cast surface of the housing. Pads of elastomeric material are placed between the reflector and the housing to compensate for discrepancies between the two components. The lamp receptacle is suspended from thin metallic bars or strips that in turn mount to as-cast surfaces of the housing. When these signals are built, the distance from the receptacle to the reflector must be manually adjusted for optimum light output. This often entails bending of the metallic strips and manipulation of the reflector. Such mounting means in the prior art signal are shown in prior art FIGS. 1 and 2.

Referring to FIGS. 1 and 2, a prior art highway crossing signal 5 generally comprises a parabolic reflector 7 enclosed within a suitably configured cast metallic case 6. A suitable door 8 contains a colored roundel 9; door 8 may be readily opened whenever access to the internal parts of the signal is required. An incandescent electric lamp 10 is located such that the filament of lamp 10 coincides with the focal point of reflector 7. Lamp 10 is retained by lamp receptacle 11, which is supported by suitably configured metallic strips 12. Insulating sleeving or tape 13 is placed between the lamp receptacle 11 and metallic strip 12 in order to electrically insulate the lamp receptacle 11 from the rest of the signal. This insulation is necessary to meet the insulation standards of the signaling industry. A cast metallic bracket 14 supports the entire lamp assembly. Elastomeric pads 15 are placed between reflector 7 and case 6. A single mounting bolt 17 is used to exert mounting pressure on reflector 7 through mounting plug 16, thereby compressing elastomeric pads 15 and retaining the reflector at the desired location.

When the signal unit 5 is assembled, it is necessary for the assembly personnel to bend the metallic strips 12 in order to position the lamp filament at the reflector focal point to obtain the best light output from the signal. This can be a time-consuming procedure. Also, tightening of bolt 17 can deform the reflector and impair its optical efficiency. Degradation of the elastomeric mounting pads 15 due to aging and weather conditions can cause shifting of the reflector 7, thus impairing the light output of the signal unit.

SUMMARY OF THE INVENTION

The present invention describes a method of construction for a railroad-highway crossing signal that does not mount the lamp receptacle and reflector to as-cast surfaces. The invention instead utilizes machined surfaces to mount these components. An improved lamp receptacle bracket is configured so as to support a lamp receptacle that is already widely used in the signalling industry. The receptacle is mounted in such a way that it may be electrically isolated from the rest of the signal without the use of manually applied tapes, sleeving, or other insulation means.

The principle optical components in the presently preferred railroad signal are a reflector and a lamp receptacle. The signal unit built by the proposed method of construction will mount both the reflector and the lamp receptacle to machined surfaces. Therefore, the distance between them may be consistently controlled, with great precision, preferably at the focal length of the reflector. This precision will aid assembling personnel in constructing the signals as only minimal adjustments will be necessary after assembly.

The railway signal has a housing, in which the housing has first and second surfaces thereupon. One or more portions of the second surface are machined so as to have a selected height. The machined portions of the second surface are each preferably raised bosses that are first cast into the housing and are then machined. Preferably, the housing has a generally annular ledge provided thereon, and the first and second portions of the housing that have machined portions are the opposed annular surfaces of the ledge.

A reflector is mounted upon the first ledge surface. As with signals of the prior art, the reflector is sized and configured such that when the reflector is attached to the signal housing, the signal has a focal point. The focal point is the location of the signal in which a light source that is provided at the focal point is directed outward of the signal as a beam.

Also attached to the signal housing is a lamp receptacle bracket. The lamp receptacle bracket may be made of any suitably sturdy material and is preferably made of aluminum. The lamp receptacle bracket has a first end that is mounted upon the one or more machined portions of the second ledge surface. The lamp receptacle bracket also has a second end that has a lamp receptacle attached thereto.

The lamp receptacle bracket has a generally flat mounting plate that is matable and is secured to the machined portions of the second ledge surface. The lamp receptacle bracket further has an elongated extending portion. The lamp receptacle bracket extending portion is connected at its first end to the lamp receptacle bracket mounting plate and extends outward therefrom. The lamp receptacle bracket also has a connecting portion that is disposed at the second end of the extending portion.

The connecting portion of the lamp receptacle bracket has a generally flat surface with at least one and preferably two slotted openings provided therethrough. The lamp receptacle also has a generally flat portion with at least one and preferably two openings provided therethrough. The flat portion of the lamp receptacle and the flat surface of the lamp receptacle bracket are sized and configured such that the flat portion of the lamp receptacle is matable with and securable to the flat surface of the lamp receptacle bracket connecting portion. When the lamp receptacle flat portion is mated to the lamp receptacle bracket flat surface, each of the openings of the lamp receptacle flat portion are alignable with respective openings of the lamp receptacle bracket flat surface. Thus, connecting means, such as a threaded bolt may be disposed through respective aligned openings.

The signal also has a light source. The light source is contained by the lamp receptacle. By attaching the lamp receptacle bracket to the signal housing, the light source is positioned at the signal focal point. The preferred light source is an incandescent electric lamp.

Electrical insulation is preferably provided to electrically isolate the lamp receptacle from the lamp receptacle bracket. The preferred electrical insulation is an insulating plate disposed between the lamp receptacle flat portion and the lamp receptacle bracket flat surface. The insulating plate is preferably made of molded thermoplastic, such as nylon; however, any suitable insulating material may be used. The insulating plate may be secured in its position by any convenient means. The preferred means of securing the position of the insulating plate is by providing openings through the insulating plate. The insulating plate openings are then aligned with the aligned openings of the lamp receptacle flat portion and the lamp receptacle bracket flat surface. Thus, the connecting means, i.e., the bolt, for example, may also be disposed through the openings of the insulating plate. These bolts are also electrically insulated from the lamp receptacle bracket by being contained within suitable insulating bushings.

It is also preferred that one or more portions of the first ledge surface be machined so as to have a selected height. The reflector is then preferably mounted upon the machined portions of the first ledge surface. Preferably, three portions of the first ledge surface are machined so as to have selected heights. The machined portions of the first ledge surface are each preferably raised bosses that are first cast into the housing ledge before being machined. Thus, the reflector is mounted upon three machined portions of the first ledge surface that are spaced approximately 120° apart.

The lamp receptacle bracket described herein is so configured as to be readily adjustable in all three axes. Also, after the lamp has been located in the desired position, the bracket may be reliably secured. Further, as the reflector mounts directly to machined surfaces, elastomeric mounting pads are no longer necessary.

Other objects and advantages of the invention will become apparent from a description of certain present preferred embodiments thereof shown in the drawings.

DETAILED DESCRIPTION OF THE PREFERRED EMBODIMENTS

Figure 2:
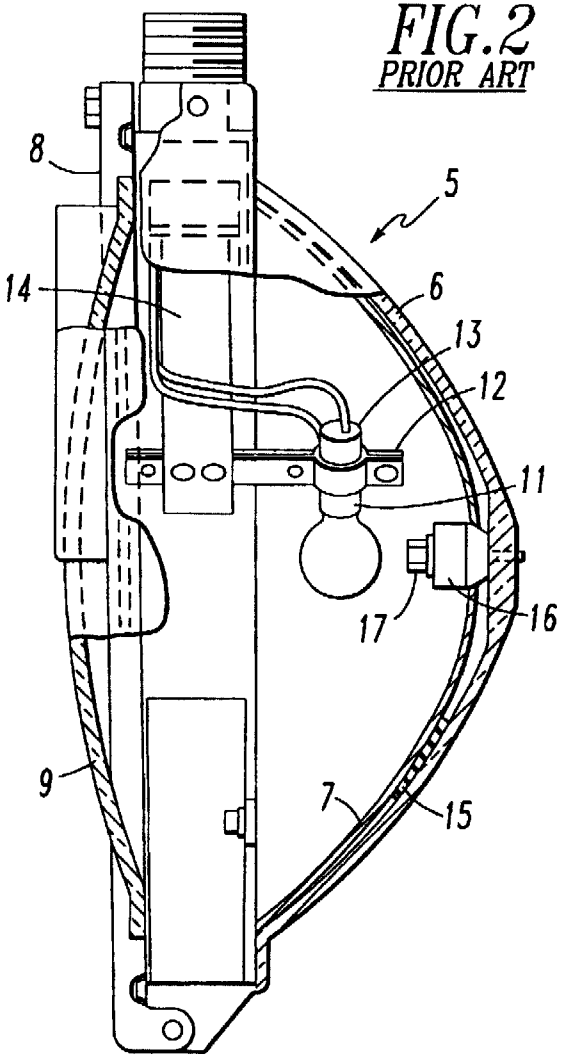
FIG. 2 PRIOR ART
FIG. 2 is a side elevational view of the prior art signal unit of FIG. 1 shown partially in cross section and partially broken away showing hidden lines.
Figure 1:
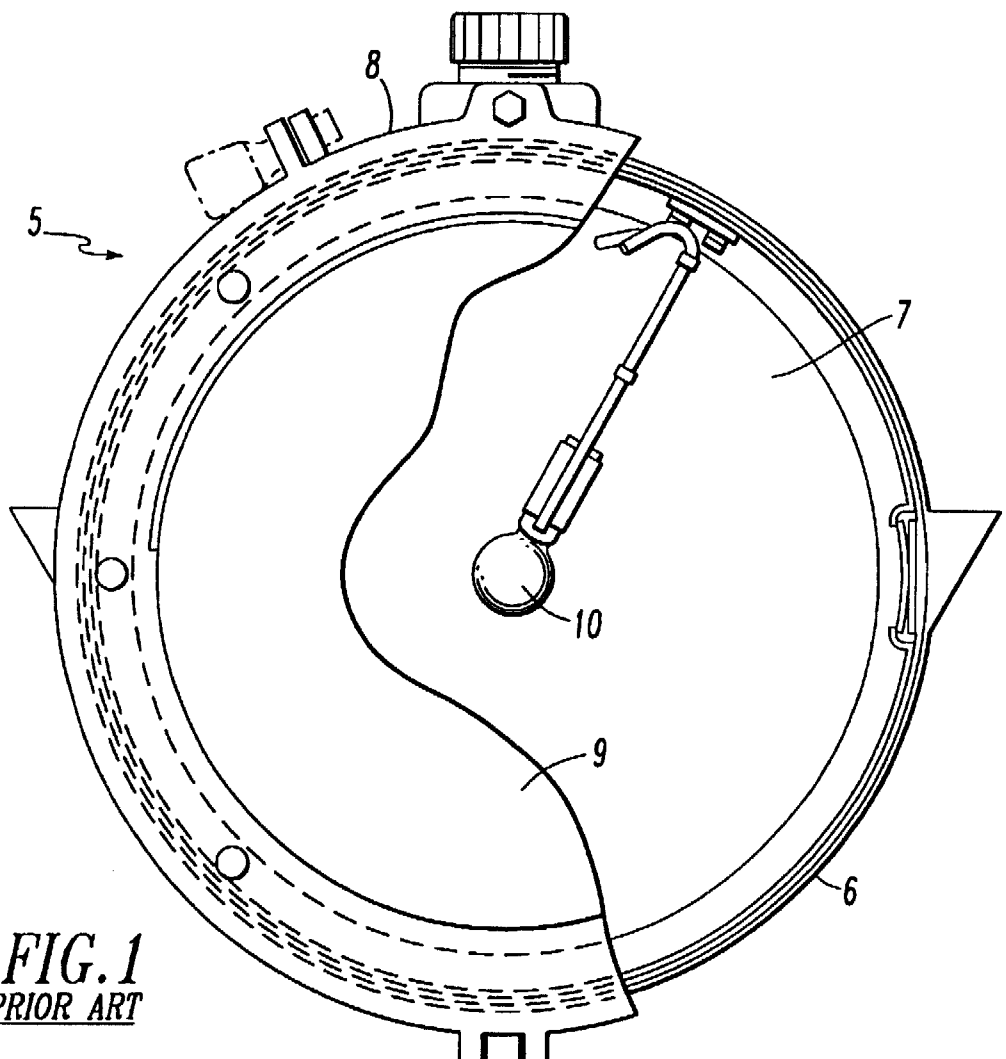
FIG. 1 PRIOR ART
FIG. 1 is a front elevational view partially broken away and showing hidden lines of a prior art signal unit.
Figure 3:
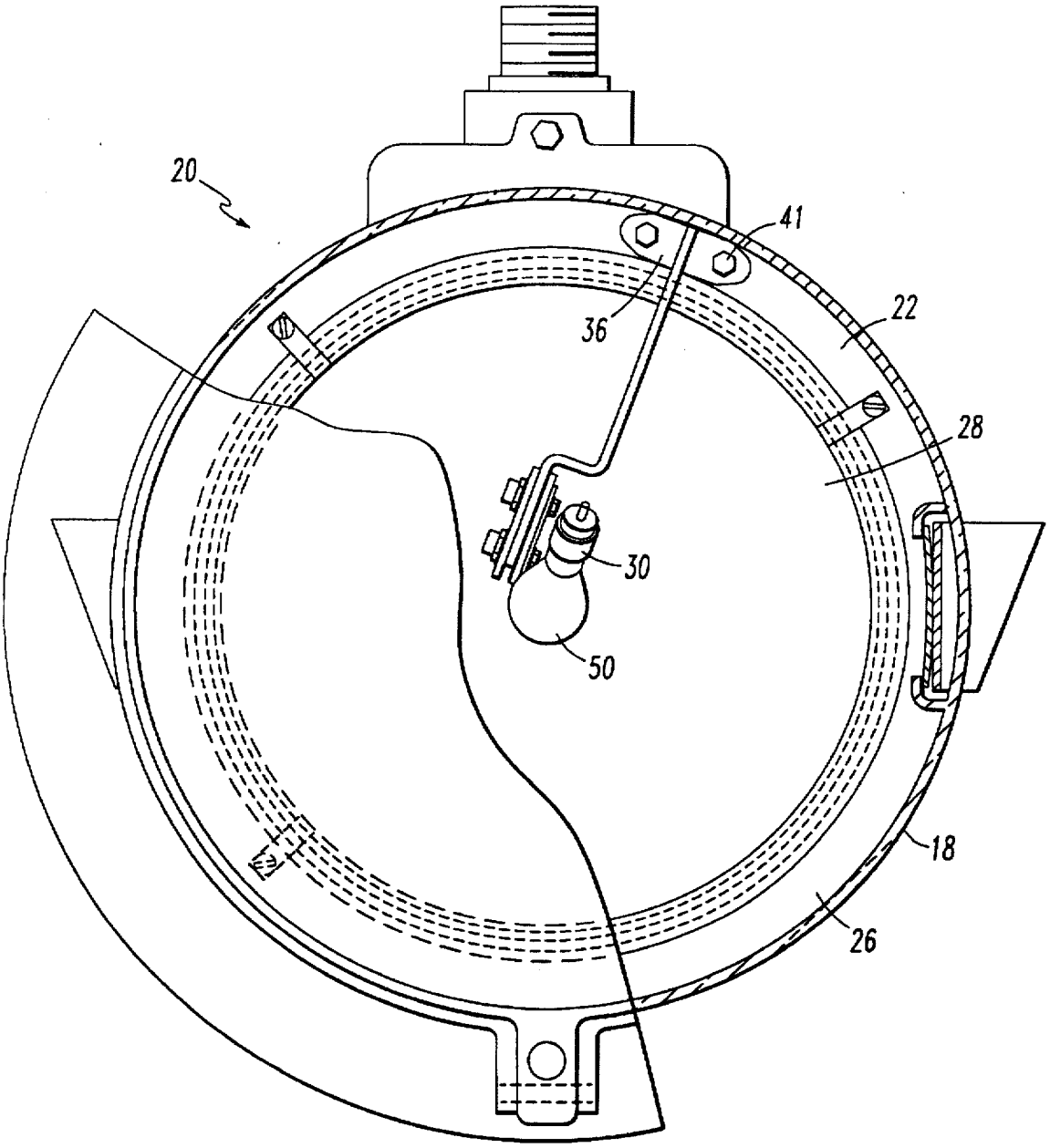
FIG. 3 is a front elevational view partially broken away and showing hidden lines of the presently preferred signal unit.
Figure 4:
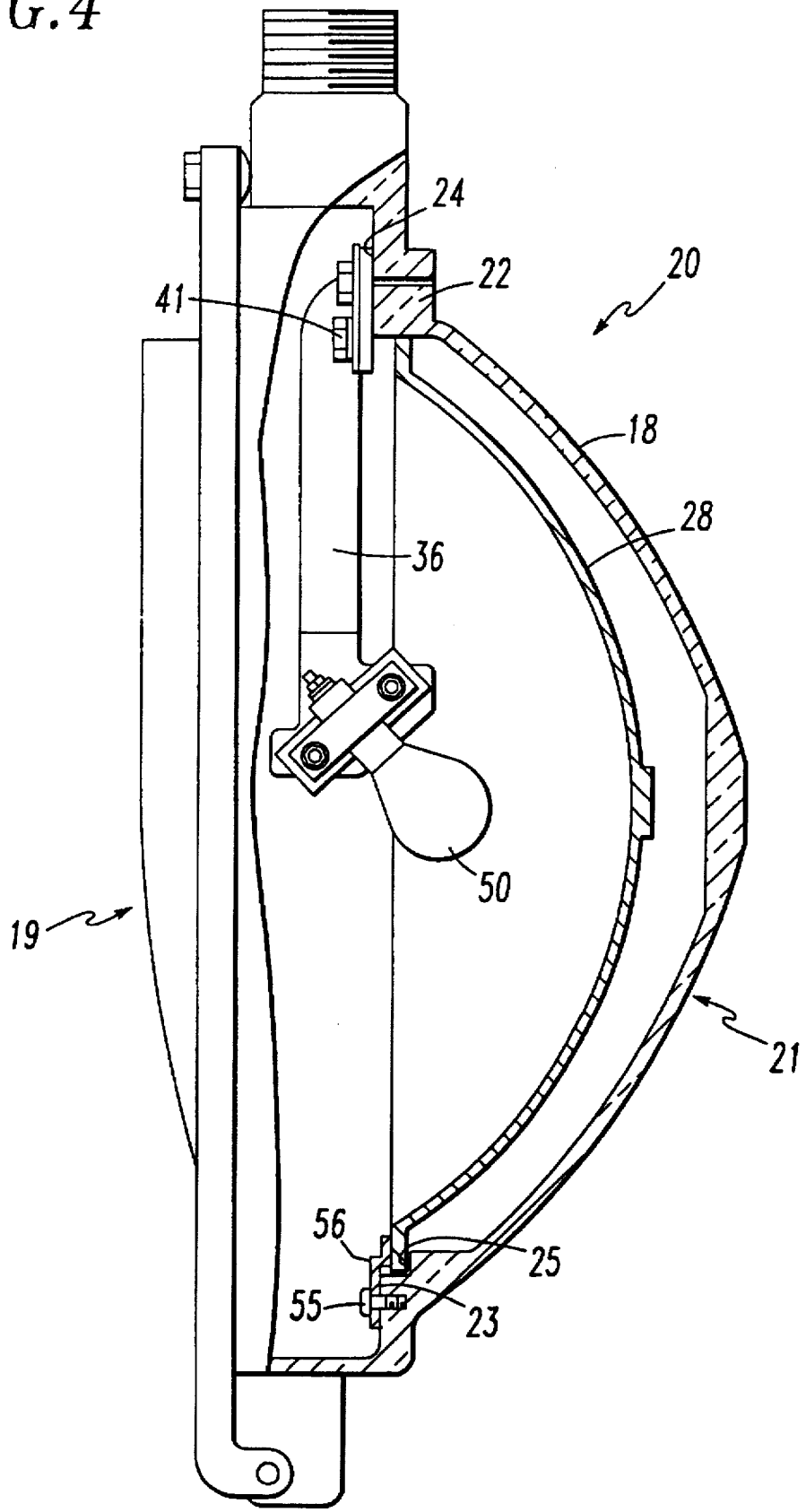
FIG. 4 is a side elevational view partially broken away and showing hidden lines of the presently preferred signal unit.

Referring to FIGS. 3 and 4, the railway signal 20 has a case or housing 18. Preferably, the signal housing 18 is produced by being cast. The signal housing 18 is preferably cast of aluminum, but may be made of any other suitable material. The signal housing 18 has front 19 and rear sides 21 and also has a first surface 23 and a second surface 22 thereupon. The signal housing 18 contains a reflector 28 and a lamp receptacle assembly that generally is composed of a lamp 50, a lamp receptacle 30 and a lamp receptacle bracket 36. One or more portions 24 of the housing second surface 22 are preferably machined so as to have a selected height. The machined portions 24 of the housing second surface 22 are each preferably raised bosses that are first cast into the signal housing 18 and are then machined.

It is also preferred that the signal housing 18 has a generally annular ledge 26 provided thereon. Thus, the first and second surfaces 23, 22 of the signal housing 18 that have machined portions 25, 24 thereon are preferably the opposed annular surfaces of the ledge 26.

A reflector 28 is mounted upon the machined portion 25 of first ledge surface 23. As with signals of the prior art, the reflector 28 is sized and configured such that when the reflector 28 is attached to the signal housing 18, the signal 20 has a focal point. The focal point is the location of the signal 20 in which a light source 50 that is provided at the focal point is directed outward of the signal 20 as a beam. Spring clips 56 tensioned by machine screws 55, secure the reflector 28 against machined surfaces 25.

Referring to FIGS. 3 through 6, the present preferred signal 20 has a lamp receptacle bracket 36 for supporting a lamp receptacle 30. The lamp receptacle 30 holds a light source or lamp 50, typically an incandescent lamp therein. The lamp receptacle bracket 36 is attached to the signal housing 18. The lamp receptacle bracket 36 is mounted at one end upon the one or more machined portions 24 of the second ledge surface 22. The lamp receptacle bracket 36 also has a lamp receptacle 30 attached to an opposite end thereto. The lamp receptacle bracket 36 may be made of any suitably sturdy material and is preferably made of aluminum.

The lamp receptacle bracket 36 further has a generally flat mounting plate 38 that is matable with and is secured to the machined portions 24of the second ledge surface 22. The mounting plate 38 of the lamp receptacle bracket 36 has openings 39 provided therethrough. The mounting plate 38 of the lamp receptacle bracket 36 is mounted to the machined portions 24 of the second ledge surface 22 by means of a threaded bolt or screw 41 being disposed through the mounting plate opening 39 and corresponding openings in the signal housing 18.

The lamp receptacle bracket 36 also has an elongated extending portion 40 that is connected at one end to the lamp receptacle bracket mounting plate 38 and extends outward therefrom. The lamp receptacle bracket 36 also has a connecting portion 42 that is disposed at an opposite end of the extending portion 40.

The connecting portion 42 of the lamp receptacle bracket 36 has a generally flat surface 44 with at least one and preferably two slotted openings 46 provided therethrough. The lamp receptacle 30 also has a generally flat portion 32 with at least one and preferably two openings 34 provided therethrough. The flat portion 32 of the lamp receptacle 30 and the flat surface 44 of the lamp receptacle bracket connecting portion 42 are sized and configured such that the flat portion 32 of the lamp receptacle 30 is matable with and securable to the flat surface 44 of the lamp receptacle bracket connecting portion 42. When the lamp receptacle flat portion 32 is mated to the lamp receptacle bracket connecting portion flat surface 44, each of the openings 34 of the lamp receptacle flat portion 32 are alignable with respective slotted openings 46 of the lamp receptacle bracket connecting portion 42. Thus, connecting means 48, such as a threaded bolt may be disposed through respective aligned openings 34, 46.

The signal 20 also has a light source 50. The light source 50 is contained by the lamp receptacle 30. The lamp receptacle is in turn secured to the signal housing 18 by the lamp receptacle bracket 36. By attaching the lamp receptacle bracket 36 to the signal housing 18, the light source 50 is positioned at the signal focal point. The preferred light source 50 is an incandescent electric lamp.

Electrical insulation is preferably provided to electrically isolate the lamp receptacle from the lamp receptacle bracket. The preferred electrical insulation is an insulating plate 52 disposed between the lamp receptacle flat portion 32 and the lamp receptacle bracket connecting portion 42. The insulating plate 52 is preferably made of molded thermoplastic, such as nylon; however, any suitable insulating material may be used. The insulating plate 52 may be secured in its position by any convenient means. The preferred means of securing the position of the insulating plate is by providing openings 54 through the insulating plate 52. The insulating plate openings 54 are then aligned with the aligned openings 34, 46 of the lamp receptacle flat portion and the lamp receptacle bracket flat connecting portion. Thus, the connecting means 48, i.e., the bolt, for example, may also be disposed through the openings 54 of the insulating plate 52. A bushing or sleeve 49 of any suitable insulating material, insulates connecting means 48 from bracket connecting portion 42.

It is also preferred that one or more portions 25 of the first ledge surface 23 be machined so as to have a selected height. The reflector 28 is then preferably mounted upon the machined portions 25 of the first ledge surface 23. The reflector 28 thus abuts a number of machined portions 25 on the signal housing 18. A number of mounting clips 56 secure the reflector 28 against the machined portions 25 of the first ledge surface 23. The clips are made from spring bronze, so as to exert force on the reflector when screws 55 are tightened. Preferably, three portions 25 of the first ledge surface 23 are machined so as to have selected heights. The machined portions 25 of the first ledge surface 23 are each preferably raised bosses that are first cast into the housing ledge 26 before being machined. Thus, the reflector 28 is mounted upon three machined portions 25 of the first ledge surface 23 that are spaced approximately 120° apart.

Therefore, the lamp receptacle bracket 36 which positions the lamp receptacle 30 and, hence the light source 50, and the reflector 28 abut a number of machined structures 24, 25 of the signal housing 18. The relative positions of the reflector 28 and the light source 50 thus may be closely controlled by controlling the amount of stock machined from the machined portions 25, 24 of the first and second surfaces 23, 22 of the signal housing 18.

Figure 6:
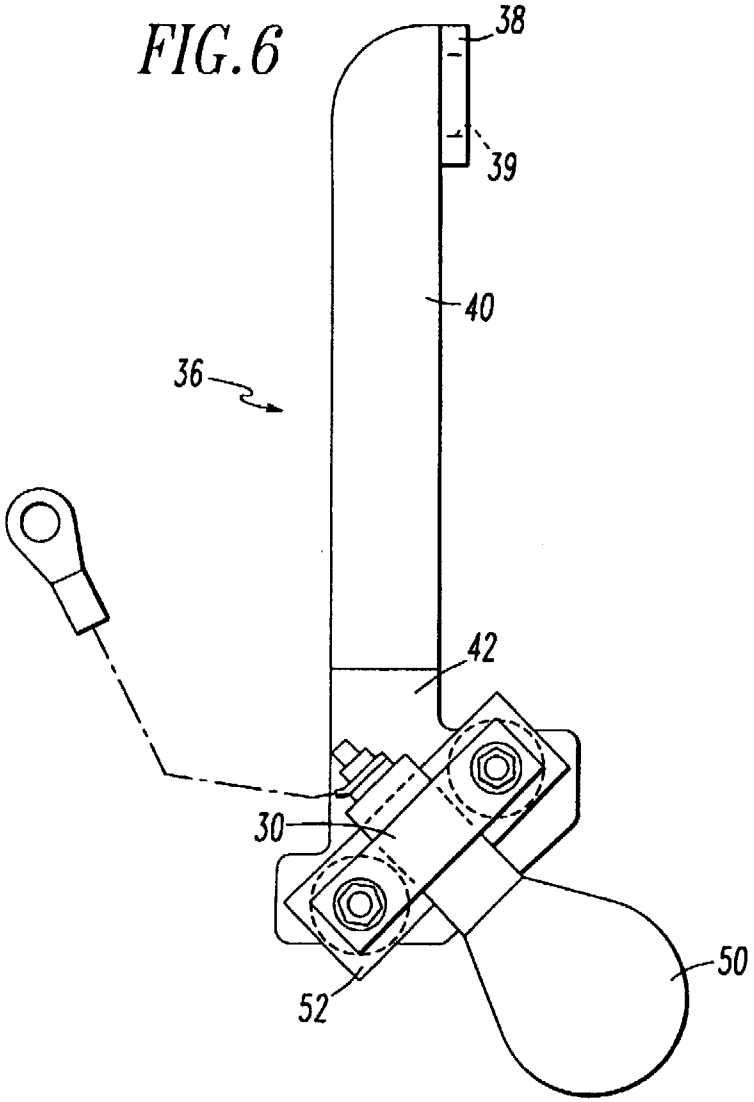
FIG. 6 is a side elevational view of the preferred lamp receptacle bracket assembly.
Figure 5:
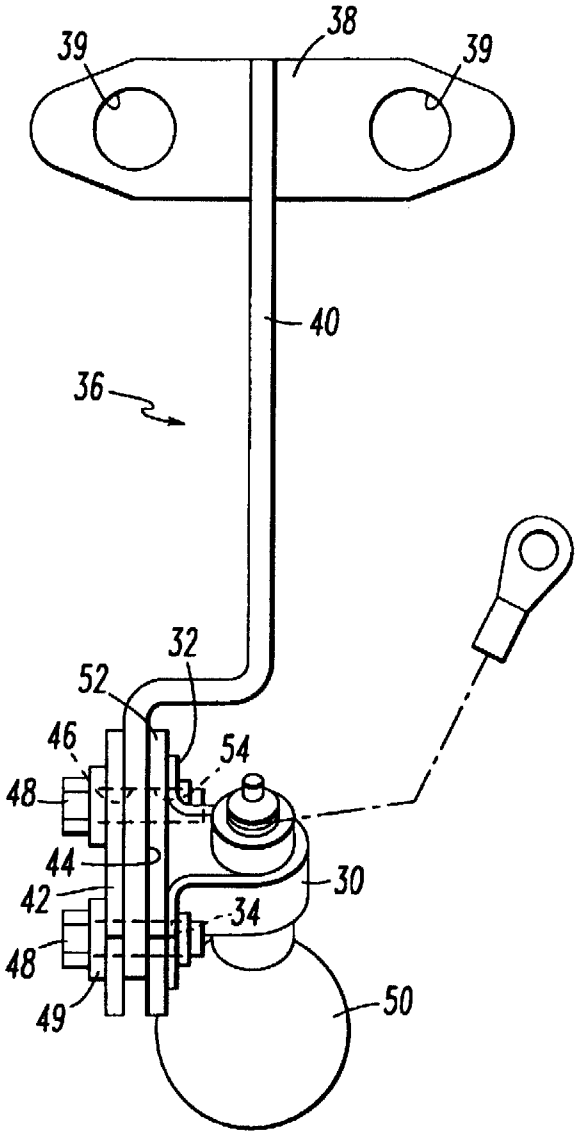
FIG. 5 is a front elevational view of the preferred lamp receptacle bracket assembly.

The lamp receptacle assembly, shown in greater detail in FIGS. 5 and 6, consists of the lamp receptacle 30, the lamp receptacle bracket 36 and the light source 50. The lamp receptacle bracket 36 is cast or otherwise formed from aluminum or other suitable material. The lamp receptacle bracket 36 is equipped with suitable openings at one end and holes at the other end. The lamp receptacle 30 is mounted by means of machine screws 48 to the openings 46 of the bracket connecting portion 42.

The lamp receptacle 30 is a standard railroad signaling receptacle that is already in use in other types of signaling apparatus. The lamp receptacle 30 is designed to accept a standard single contact bayonet candelabra-based signal lamp 50. The machine screws 48 engage the threaded holes 34 in the receptacle 30 and are concentrically enclosed by insulating bushings 49 where the screws 48 pass through the openings 46. An insulating plate 52 is interposed between the lamp receptacle flat portion 32 and the lamp receptacle bracket 36. Then, screws fasten the lamp receptacle assembly to the signal housing 18 at the lamp receptacle bracket mounting plate 38. The remainder of the signal unit 20 is substantially similar to the signal units of the prior art.

A focusing operation must be performed after assembly of the signal unit to ensure that the signal unit is delivering a concentrated beam of light. This focusing operation is performed as follows. First, the machine screws 48 are loosened sufficiently to permit the receptacle to move along the axis of the reflector by means of slotted holes 46, until the point is reached where the most intense light beam is emitted by the signal unit. The screws are then tightened and the screws 41 which fasten the lamp receptacle assembly to the case are then loosened so that the lamp receptacle assembly may be shifted about in the plane perpendicular to the axis of the reflector. When the lamp receptacle is located such that beam of light from the signal unit is parallel to the axis of the reflector, the screws fastening the lamp receptacle assembly to the signal case are tightened. The setting of the lamp receptacle assembly may then be locked by sealing the threads of the screws by any suitable means.

While certain present preferred embodiments have been shown and described, it is distinctly understood that the invention is not limited thereto but may be otherwise embodied within the scope of the following claims.

We claim:

1. A railway signal, comprising:

a housing having first and second surfaces thereupon, wherein at least one portion of said second surface is machined so as to have a selected height;

a reflector mounted upon said first surface, wherein said signal has a focal point in which a light source provided at said focal point is directed outward of said signal as a beam; and a lamp receptacle bracket having a first end and a second end, wherein said first end of said lamp receptacle bracket is mounted upon said at least one machined portion of said second surface, and wherein said second end of said lamp receptacle bracket has a lamp receptacle attached thereto and wherein said housing has a generally annular ledge thereon, and wherein said first surface of said housing is one generally annular surface of said ledge and said second surface of said housing is an opposite surface of said annular ledge.

2. The railway signal of claim 1 wherein said lamp receptacle bracket has a generally flat mounting plate which is matable and is securable to said at least one machined portion of said second ledge surface.

3. The railway signal of claim 2 wherein said lamp receptacle bracket further has an extending portion having first and second ends wherein said extending portion is connected at said first end to said mounting plate and extends outward therefrom, and wherein said lamp receptacle bracket has a connecting portion disposed at said second end of said extending portion.

4. The railway signal of claim 3 wherein said connecting portion of said lamp receptacle bracket has a generally flat surface with at least one opening provided thereon.

5. The railway signal of claim 4 wherein said lamp receptacle has a generally flat portion and wherein said flat portion of said lamp receptacle is matable and is secured to said flat surface of said lamp receptacle bracket connecting portion.

6. The railway signal of claim 5 wherein when said lamp receptacle flat portion has at least one opening parallel thereon and is mated to said lamp receptacle bracket flat surface, each said at least one opening of said lamp receptacle flat portion is alignable with respective ones of said at least one opening of said lamp receptacle bracket flat surface so that connecting means may be disposed through respective aligned openings.

7. The railway signal of claim 6 further comprising an insulating plate disposed between said lamp receptacle flat portion and said lamp receptacle bracket flat surface.

8. The railway signal of claim 7 wherein said insulating plate is made of a material selected from the group consisting of molded plastic insulting materials.

9. The railway signal of claim 7 wherein said insulating plate has openings provided therethrough, in which said insulating plate openings are alignable with said aligned openings of said lamp receptacle flat portion and said lamp receptacle bracket flat surface, such that said connecting means may also be disposed therethrough.

10. A railway signal, comprising:

a housing having first and second surfaces thereupon, wherein at least one portion of said second surface is machined so as to have a selected height;

a reflector mounted upon said first surface, wherein said signal has a focal point in which a light source provided at said focal point is directed outward of said signal as a beam; and a lamp receptacle bracket having a first end and a second end, wherein said first end of said lamp receptacle bracket is mounted upon said at least one machined portion of said second surface, and wherein said second end of said lamp receptacle bracket has a lamp receptacle attached thereto, and wherein at least one portion of said first surface is machined so as to have a selected height, and wherein said reflector is mounted upon said at least one machined portion of said first surface and wherein said at least one machined portion of said first surface are each integral raised bosses cast into said housing.

11. A railway signal, comprising:

a housing having first and second surfaces thereupon, wherein at least one portion of said second surface is machined so as to have a selected height;

a reflector mounted upon said first surface, wherein said signal has a focal point in which a light source provided at said focal point is directed outward of said signal as a beam; and a lamp receptacle bracket having a first end and a second end, wherein said first end of said lamp receptacle bracket is mounted upon said at least one machined portion of said second surface, and wherein said second end of said lamp receptacle bracket has a lamp receptacle attached thereto and wherein said at least one machined portion of said second surface are each integral raised bosses cast into said housing.

12. The railway signal of claim 11 wherein said lamp receptacle bracket has a generally flat plate which is operable and is securable to said at least one machined portion of said second surface.

13. A railway signal, comprising:

a housing having first and second surfaces thereupon, wherein at least one portion of said second surface is machined so as to have a selected height;

a reflector mounted upon said first surface, wherein said signal has a focal point in which a light source provided at said focal point is directed outward of said signal as a beam; and a lamp receptacle bracket having a first end and a second end, wherein said first end of said lamp receptacle bracket is mounted upon said at least one machined portion of said second surface, and wherein said second end of said lamp receptacle bracket has a lamp receptacle attached thereto and wherein said lamp receptacle bracket has a generally flat mounting plate which is matable and is secured to said at least one machined portion of said second surface and wherein said lamp receptacle bracket further has an extending portion having first and second ends wherein said extending portion is connected at said first end to said mounting plate and extends outward therefrom, and wherein said lamp receptacle bracket has a connecting portion disposed at said second end of said extending portion and wherein said connecting portion of said lamp receptacle bracket has a generally flat surface with at least one opening provided thereon.

14. The railway signal of claim 13 wherein said lamp receptacle has a generally flat portion with at least one opening provided thereon and wherein said flat portion of said lamp receptacle is matable and is secured to said flat surface of said lamp receptacle bracket connecting portion.

15. The railway signal of claim 14 wherein when said lamp receptacle flat portion is mated to said lamp receptacle bracket flat surface, each said at least one opening of said lamp receptacle flat portion is alignable with respective ones of said at least one opening of said lamp receptacle bracket flat surface so that connecting means may be disposed through respective aligned openings.

16. The railway signal of claim 15 further comprising an insulating plate disposed between said lamp receptacle flat portion and said lamp receptacle bracket flat surface.

17. The railway signal of claim 16 wherein said insulating plate is made of a material selected from the group consisting of molded plastic insulating materials.

18. The railway signal of claim 16 wherein said insulating plate has openings provided therethrough, in which said insulating plate openings are alignable with said aligned openings of said lamp receptacle flat portion and said lamp receptacle bracket flat surface, such that said connecting means may also be disposed therethrough.

19. A method of producing a railway signal comprising the steps of:

providing a signal housing having a first surface and a second surface;

providing at least one integral raised planar boss on said signal housing second surface such that said integral raised planar boss has a flat surface and a selected height;

providing a lamp receptacle bracket having a lamp receptacle secured thereto, wherein said lamp receptacle bracket has a planar mounting portion;

mating and securing said planar mounting portion of said lamp receptacle bracket to said integral raised boss of said signal housing second surface;

providing at least one integral raised planar boss on said signal housing first surface such that said integral raised planar boss has a flat surface and a selected height;

providing a signal reflector; and mating and securing said reflector to said integral raised planar boss of said signal housing first surface.

20. The method of producing a railway signal of claim 19 wherein said integral raised boss of said signal housing first surface is cast upon said signal housing first surface.

21. The method of producing a railway signal of claim 20 wherein said integral raised boss of said signal housing first surface is machined so as to have a first flat surface and a selected height of said first surface.

* * * * *

UNITED STATES PATENT AND TRADEMARK OFFICE

CERTIFICATE OF CORRECTION

PATENT NO. : 5,664,744

DATED : September 9, 1997

INVENTOR(S) : JAMES P. CHEW, SANTO A. DEFRANCESCO, RICHARD S. JONES

It is certified that error appears in the above-indentified patent and that said Letters Patent is hereby corrected as shown below:

Column 7, claim 12, line 55, after "flat" insert --mounting--.

Signed and Sealed this

Ninth Day of December, 1997

Bruce Lehman

*Attest:*

BRUCE LEHMAN

*Attesting Officer*

*Commissioner of Patents and Trademarks*